US008508447B2

(12) United States Patent
Pyayt et al.

(10) Patent No.: US 8,508,447 B2
(45) Date of Patent: Aug. 13, 2013

(54) DISPLAY DEVICE AND PIXEL THEREFOR

(75) Inventors: Anna Pyayt, Seattle, WA (US); Gary K. Starkweather, DeBary, FL (US); Michael J. Sinclair, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 873 days.

(21) Appl. No.: 11/941,984

(22) Filed: Nov. 19, 2007

(65) Prior Publication Data

US 2009/0128589 A1 May 21, 2009

(51) Int. Cl.
*G09G 3/34* (2006.01)

(52) U.S. Cl.
USPC ..... 345/85; 385/129; 385/901; 385/43; 345/204; 345/87; 345/84; 345/694; 345/108; 348/770; 348/771

(58) Field of Classification Search
USPC ..... 345/87, 204, 157, 84–85, 694, 108; 385/129, 901, 43; 348/770–771
See application file for complete search history.

(56) References Cited

U.S. PATENT DOCUMENTS

| | | | | |
|---|---|---|---|---|
| 5,129,028 | A | 7/1992 | Soltan | |
| 5,192,946 | A * | 3/1993 | Thompson et al. | 348/764 |
| 5,633,755 | A * | 5/1997 | Manabe et al. | 359/443 |
| 5,640,479 | A | 6/1997 | Hegg et al. | |
| 5,729,386 | A | 3/1998 | Hwang | |
| 5,946,547 | A | 8/1999 | Kim et al. | |
| 6,132,053 | A | 10/2000 | Sendova | |
| 6,137,623 | A * | 10/2000 | Roberson et al. | 359/291 |
| 6,229,684 | B1 * | 5/2001 | Cowen et al. | 361/278 |
| 6,233,088 | B1 * | 5/2001 | Roberson et al. | 359/291 |
| 6,262,696 | B1 | 7/2001 | Seraphim et al. | |
| 6,316,278 | B1 | 11/2001 | Jacobsen et al. | |
| 6,329,967 | B1 | 12/2001 | Little et al. | |
| 6,353,492 | B2 | 3/2002 | McClelland et al. | |
| 6,418,267 | B1 | 7/2002 | Lowry | |
| 6,650,460 | B2 | 11/2003 | Kurematsu | |
| 6,654,156 | B1 | 11/2003 | Coker et al. | |
| 6,729,734 | B2 * | 5/2004 | Childers et al. | 353/122 |
| 6,775,048 | B1 | 8/2004 | Starkweather et al. | |
| 7,006,276 | B2 | 2/2006 | Starkweather et al. | |
| 7,151,627 | B2 | 12/2006 | Starkweather et al. | |

(Continued)

FOREIGN PATENT DOCUMENTS

EP 0831352 3/1998

OTHER PUBLICATIONS

"Modular LED-based edge-lighting for large-screen LCD TVs intro'd," http://www.digitaltvdesignline.com/products/showArticle.jhtml?articleID=197007682 (last visited Sep. 20, 2007), pp. 1-2.

(Continued)

*Primary Examiner* — Lun-Yi Lao
*Assistant Examiner* — Shaheda Abdin
(74) *Attorney, Agent, or Firm* — Westman, Champlin & Kelly, P.A.

(57) ABSTRACT

A pixel includes a primary element and a secondary element. At least a portion of the primary element is deformable between two positions. In one position, the light source is reflected such that the observer observes a dark pixel. In the other position, the light is reflected such that the observer observes a bright pixel. Gray levels of light are viewable by varying between the two positions.

19 Claims, 7 Drawing Sheets

(56) References Cited

U.S. PATENT DOCUMENTS

| | | | | |
|---|---|---|---|---|
| 7,283,112 | B2 | 10/2007 | Starkweather et al. | |
| 2002/0047824 | A1* | 4/2002 | Handschy et al. | 345/97 |
| 2003/0164814 | A1* | 9/2003 | Starkweather et al. | 345/102 |
| 2005/0002086 | A1* | 1/2005 | Starkweather et al. | 359/291 |
| 2006/0033865 | A1* | 2/2006 | Tanaka et al. | 349/113 |
| 2006/0091406 | A1 | 5/2006 | Kaneko et al. | |
| 2006/0244698 | A1* | 11/2006 | Koshimizu et al. | 345/80 |
| 2007/0120465 | A1 | 5/2007 | Ito et al. | |
| 2007/0121191 | A1* | 5/2007 | Pan | 359/291 |
| 2007/0166856 | A1 | 7/2007 | Lee | |
| 2008/0117151 | A1* | 5/2008 | Nurmi et al. | 345/88 |

OTHER PUBLICATIONS

Allan, Roger, "Progress on the Flexible Substrate Front," http://www.elecdesign.com/Articles/Index.cfm?AD=1&ArticleID=12733 (last visited Sep. 20, 2007), pp. 1-3.

Matthies et al., Dennis L., "Modular displays for megapixel applications," http://spiedl.aip.org/getabs/servlet/GetabsServlet?prog=normal&id=PSISDG003690000001000330000001&idtype=cvips&gifs=yes (last visited Sep. 20, 2007), pp. 1-2.

Heim, K., "Inventor Aims to Widen Horizons of PC Users," Knight Ridder Newspapers, http://www.temple.edu/ispr/examples/ex03_02_25.html (last visited Oct. 5, 2007), pp. 1-2, Feb. 2003.

Scalable Display Technologies—Multi Projector Displays, "Large, high-end, innovative displays on any surface," , http://www.scalabledisplay.com/scalable_12_apps.multi.html (last visited Oct. 5, 2007), pp. 1-5.

Lee et al., Jinwook, "Full Color Emission from II-VI Semiconductor Quantum Dot-Polymer Composites," Advanced Materials, vol. 12, No. 15, pp. 1102-1105, Aug. 2000.

Choi et al., W. B. "Fully sealed, high-brightness carbon-nanotube field-emission display," Applied Physics Letters, vol. 75, No. 20, pp. 3129-3131, Nov. 1999.

Burroughes et al., J. H., "Light-emitting diodes based on conjugated polymers," Letters to Nature, vol. 347, pp. 539-541, Oct. 1990.

Yoon et al., Tae-Hoon, "Nontwist quarter-wave liquid-crystal cell for a contract reflective display," Optics Letters, vol. 25, No. 20, pp. 1547-1549, Oct. 2000.

Qualcomm, Competitive Display Technologies White Paper, available at http://www.qualcomm.com/technology/imod/media/pdf/Competitive_Display_Technologies_White_Paper.pdf, pp. 1-20, Jan. 2007.

E-ink, Electronic Paper Displays, http://www.eink.com/technology/index.html (last visited on Oct. 5, 2007), pp. 1-2.

SiPix, The SiPix Microcup®, http://www.sipix.com/technology/index.html (last visited Oct. 5, 2007), pp. 1-3.

Hornbeck, Larry J., "Digital Light Processing: A New MEMS-Based Display Technology," available at http://dlpinside.com/downloads/default.aspx?&ref=/downloads/white_papers/117_Digital_Light_Processing_MEMS_display_technology.pdf. (added Nov. 1999), pp. 1-23.

Bloom, D. M., "The Grating Light Valve: revolutionizing display technology," proceedings of SPIE, vol. 3013, pp. 165-171, Feb. 1997.

Heikenfeld et al., J., "P-56: A Novel Fluorescent Display Using Light Wave Coupling Technology," SID International Symposium, pp. 302-305, May 2004.

Lowe et al., Anthony C., "13.3: A Novel Approach to Tiled Displays," SID Symposium Digest of Technical Papers, vol. 34, Issue 1, pp. 180-183, May 2003.

Heikenfeld et al., J., "High-transmission electrowetting light valves," Applied Physics Letters, vol. 86, Issue 15, pp. 151121-1 through 151121-3, Apr. 2005.

UniPixel, Simply Superior Overview, http://www.unipixel.com/overview.htm (last visited Oct. 5, 2007), p. 1.

"Flixel Reveals New MEMS Display," http://www.insightmedia.info/news/FlixelRevealsNewMEMS.htm (last visited Oct. 5, 2007), pp. 1-2, Jul. 2003.

Wang et al., K., "An Electrostatic Zigzag Transmissive Microoptical Switch for MEMS Displays," Journal of Microelectromechanical Systems, vol. 16, Issue 1, pp. 140-154, Feb. 2007.

Kovacs, Gregory T. A., "Micromachined Transducers Sourcebook," McGraw-Hill, Inc., p. 182-183, Feb. 1998.

MacDonald et al., Robert, "Electrostatically deformable micro-frequency selective surface," proceedings of SPIE, vol. 4809, pp. 136-148, Nov. 2002.

Fernandez-Bolanos et al., M., "Polyimide sacrificial layer for SOI SG-MOSFET pressure sensor,"Journal of Microelectronic Engineering, vol. 83, pp. 1185-1188, Sep. 2006.

* cited by examiner

DISPLAY DEVICE AND PIXEL THEREFOR

BACKGROUND

High definition (HD) television and video renders to a viewer high contrast and fine detailed images in high resolution. The differences between standard definition and HD are so visually apparent that the demand for display devices that have larger screen sizes and higher pixel densities will only continue.

However, increasing screen size and increasing pixel density exponentially increases the prices of display devices made of conventional monolithic display technologies. Conventional monolithic display technologies utilize a single panel (or chip, etc.), which is responsible for the image the user sees. These characteristics make fabricating large sized displays very tedious and their price extremely high. Modular display devices can decrease the expense of large sized display screens. A modular display device tiles many small panel displays together to form a single large display. Failure of a pixel in a modular display affects only the module that it belongs to, while a failure of a pixel in a monolithic display affects the entire display.

Modular display devices can solve other limitations of large sized monolithic displays. In particular, pixels can be addressed in an efficient fashion at a modular level. In a modular display, a controller can determine which modules need their data updated based on the sending of a new image. Rather than repainting all of the pixels as would be done in a monolithic display, only those modules that need updating will be repainted. Therefore, a modular display would require a reduced bandwidth and simplified circuitry compared to a monolithic display.

One problem that has prevented commercialization of the modular display is creating an image that flows seamlessly across the different modules. Although software has been used to blend the seams and make the screen look uniform, there are limitations in the display technologies available for modularizing. Some limitations include light efficiency, contrast, cost and scalability.

Example types of display technologies include transmissive, reflective and emissive displays. Emissive displays, except for plasma displays, are generally made of unstable materials that have short lives and/or poor color quality. Plasma displays have very large pixels, which can not be scaled down for large pixel density displays. Some reflective displays use ambient light, a very efficient light source, but fail to produce high contrast and full color images. Other reflective displays use MEMS chips, an expensive light source and a projection screen. However, these displays are too expensive for modular fabrication. Transmissive displays, such as liquid crystal displays (LCDs), have extremely low light efficiency. When modularizing LCD displays, the modular display renders even more decreased light efficiency and contrast. Other types of transmissive displays also have very low contrast and color quality or are difficult to control.

The discussion above is merely provided for general background information and is not intended to be used as an aid in determining the scope of the claimed subject matter.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

A pixel has a primary element that includes a first surface that reflects light received from a light source and a secondary element that includes a first surface that is spaced apart from and faces the first surface of the primary element. At least a portion of the primary element is deformable between a first position and a second position. In the first position, the pixel appears dark to a viewer. In the second position, the primary element focuses reflected light onto the first surface of the secondary element and the pixel appears bright to a viewer. Gray levels of light are viewable between the first position and the second position.

DETAILED DESCRIPTION

Figure 1:
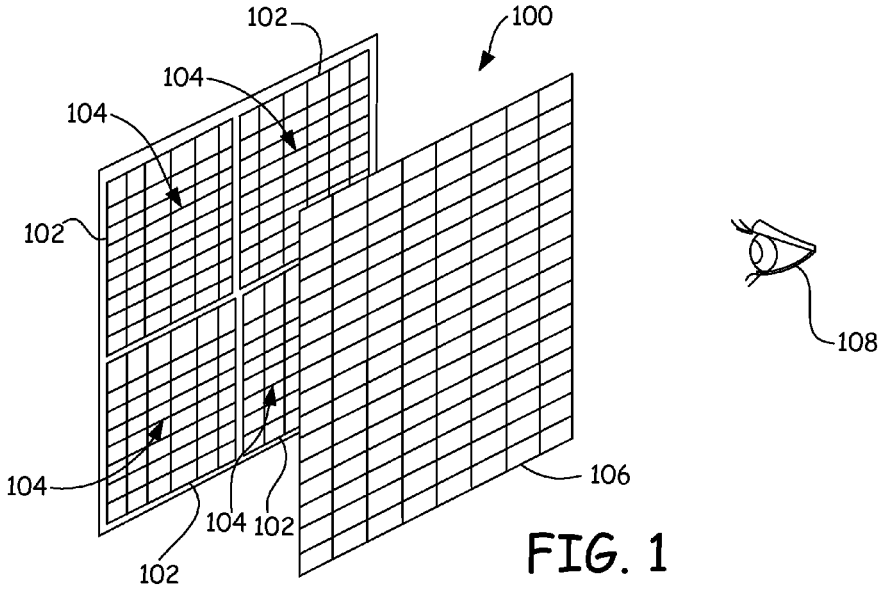
FIG. 1 illustrates a schematic diagram of a modular display under one embodiment.
Figure 2:
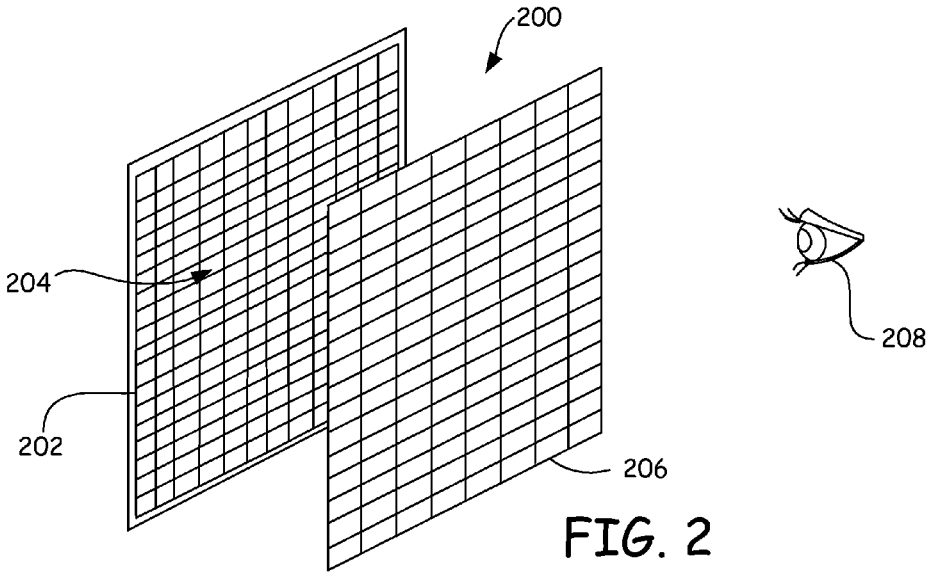
FIG. 2 illustrates a schematic diagram of a display under one embodiment.

FIG. 1 illustrates a schematic diagram of a modular display 100 under one embodiment. Modular display 100 includes a plurality of modules (of which four are illustrated in FIG. 1) 102. Each module 102 includes an array of pixels 104. Each module 102 is projected onto a continuous screen 106 for a viewer 108 to view. Since light diverges after it leaves the pixels 104, continuous screen 106, placed at an optimal distance, will look to a viewer like pixels cover the whole screen without empty space between them. In another embodiment and as illustrated in FIG. 2, display 200 can include a single module 202 having an array of pixels 204. In this embodiment, pixels 204 are not tiled together in modules as illustrated in FIG. 1, rather, the array of pixels 204 are monolithically positioned together and projected onto a continuous screen 206 for a viewer 208 to view.

Figure 3A:
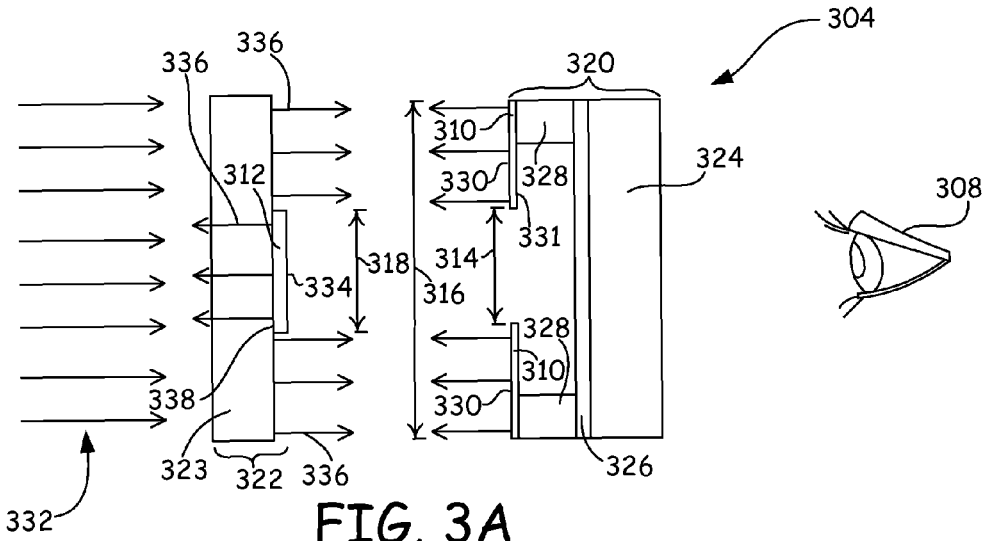
FIG. 3A illustrates a schematic diagram of a pixel in a first position under one embodiment.
Figure 4A:
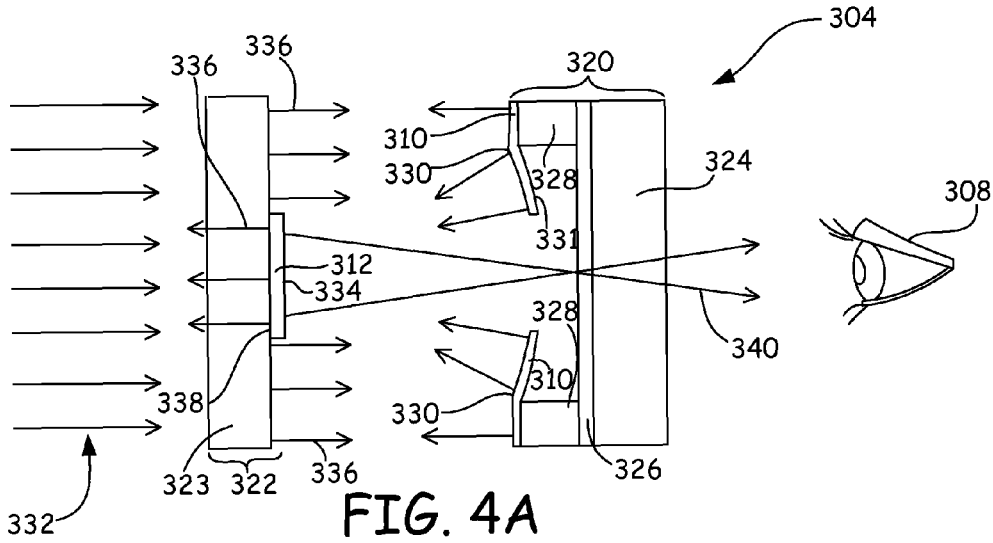
FIG. 4A illustrates a schematic diagram of the pixel of FIG. 3A in a second position under one embodiment.

FIGS. 3A and 4A illustrate schematic diagrams of a pixel 304 for use in modular display 100 of FIG. 1 or for use in monolithic display 200 of FIG. 2 under one embodiment.

FIG. 3A illustrates a first position of pixel 304, while FIG. 4A illustrates a second position of pixel 304.

In FIGS. 3A and 4A, pixel 304 includes a primary element 310 and a secondary element 312. Primary element 310 is an annular membrane or mirror having an inner diameter 314 and an outer diameter 316. A portion of primary element 310 that is in proximity to inner diameter 314 is suspended, while a remaining portion of primary element 310 that is in proximity to outer diameter 316 is fixed. Secondary element 312 is a circular mirror having an outer diameter 318. Although primary element 310 and secondary element 312 are circular in shape, it should be realized that primary element 310 and secondary element 312 can be other shapes. For example, primary element 310 and secondary element 312 can be square or rectangular in shape.

Primary element 310 is formed with a primary structure 320 and secondary element 312 is formed with a secondary structure 322. Secondary structure 322 includes a transparent substrate 323, such as glass, and second element 312 that is only coupled to a portion of secondary structure 323, while primary structure 320 includes a plurality of different layers.

Primary structure 320 includes a transparent substrate 324, such as glass. Coupled to transparent substrate 324 is a transparent conductive material or electrode 326. While it is possible that electrode 326 can be a transparent conductive polymer, indium tin oxide (ITO) is a suitable material for electrode 326 as it demonstrates a combination of electrical conductivity and optical transparency. A first spacer 328 is positioned between primary element 310 and electrode 326. The suspended or remaining portion of primary element 310 includes an aperture 327 (illustrated in FIG. 3B) that is defined by inner diameter 314. Aperture 327 is a through hole extending between first surface 330 and an opposing second surface 331 of primary element 310. Inner diameter 314 is slightly smaller than outer diameter 318 of secondary element 312. As previously described, a portion of primary element 310 is coupled to first spacer 328, while a remaining portion of primary element 310 is suspended from primary structure 320. The suspended or remaining portion of primary element 310 is deformable between a first position as illustrated in FIG. 3A and a second position as illustrated in FIG. 4A.

Primary element 310 includes a first surface 330 configured to reflect light received from a light source 332. In FIGS. 3A and 4A, and in one embodiment, secondary element 312 includes a first surface 334 that is reflective. First surface 334 of secondary element 312 is spaced apart from and faces first surface 330 of primary element 310 In one embodiment, primary element 310 and secondary element 312 comprise a metallic material, such as aluminum, that demonstrate desirable reflective, bending and conductive properties. However, it should be realized that primary element 310 can include non-metallic or dielectric materials that can demonstrate reflective, bending and conductive properties. Such materials provide primary element 310 and secondary element 312 with reflective surfaces.

Figure 3B:
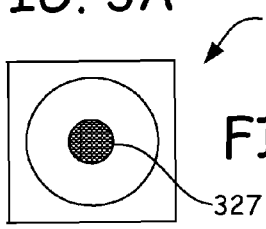
FIG. 3B illustrates a front view representation of the pixel of FIG. 3A in the first position.

As illustrated in the first position of FIG. 3A, light 336 from light source 332 enters secondary structure 322. A portion of light 336 proceeds to primary structure 320, while a remaining portion of light 336 is reflected back to light source 332 by a second surface 338 that opposes first surface 334 of secondary element 312. The portion of light 336 that proceeds to primary structure 320 reflects from first surface 330 of primary element 310, back through secondary structure 322 and towards light source 332. As illustrated in FIG. 3A, all light provided by light source 332 to pixel 304 is reflected back to light source 332 causing pixel 304 to appear dark to a viewer 308. Such a dark pixel 304 is represented in FIG. 3B.

At least a portion of primary element 310 is deformed into the second position as illustrated in FIG. 4A. A voltage is simultaneously applied between primary element 310, which is conductive, and electrode 326. While the portion of primary element 310 that is fixed to first spacer 328 remains in position, the suspended or remaining portion of primary element 310 is pulled towards electrode 326 by the electrostatic force caused by the application of voltage. The electrostatic force causes the shape of primary element 310 to deform from a planar shape to a parabolic shape.

Figure 4B:
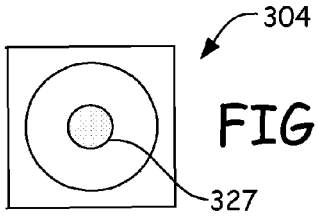
FIG. 4B illustrates a front view representation of the pixel of FIG. 4A in the second position.

As illustrated in the second position of FIG. 4A, light 336 from light source 332 enters transparent substrate 323. A portion of light 336 proceeds to primary structure 320, while a remaining portion of light 336 is reflected back to light source 332 by second surface 338 that opposes first surface 334 of secondary element 312. The portion of light 336 that proceeds to primary structure 320 partially reflects from the fixed portion of primary element 310 back through transparent substrate 323, towards light source 332 and partially reflects from the deformed portion of primary element 310 that is suspended. The light that reflects from the deformed portion of primary element 310 is focused on first surface 334 of secondary element 312. Reflected light 340 from first surface 334 of secondary element 312 propagates through aperture 327 (illustrated in FIG. 4B) that is defined by inner diameter 314 of primary element 310 such that pixel 304 appears bright to viewer 308. Such a bright pixel 304 is represented in FIG. 4B.

Pixel 304 of FIGS. 3A, 3B, 4A and 4B is light efficient and can be brighter than other types of displays that have a similar light source, thus, eliminating the need to darken a room in which the pixel is be used for viewing. In addition, pixel 304 is not sensitive to temperature changes or expensive packaging because it operates in atmospheric conditions. Pixel 304 also deforms between the first position illustrated in FIG. 3A and the second position illustrated in FIG. 4A at a relatively fast rate (approximately less than 2 ms). Such a rate of change allows pixel 304 to utilize sequential RGB color light sources. In addition, different color shades in accordance with different intensities of light can be realized in a single cycle between the first position and the second position by varying the amount of voltage applied between electrode 326 and primary element 3 10.

A plurality of circular shaped primary elements 310 and secondary elements 312 can be stacked in an array of pixels as illustrated in FIGS. 1 and 2. Even though a portion of light 336 from light source 332 reflects from second surface 338 of secondary element 312, reflects from the portion of primary element 310 that is fixed to primary structure 320 and is loss due to reflection on several of the glass and metal surfaces, the light efficiency that viewer 308 is expected to view is approximately 50%, which is 5-10 times more than that of a liquid crystal display. Pixel 304 also solves the problem of a transmissive imager, where the free aperture of each pixel is limited by the opaque backplane circuitry. Pixel 304 can use circuitry that is placed under primary element 310 so as not to block light and achieve a high fill factor.

Figure 5:
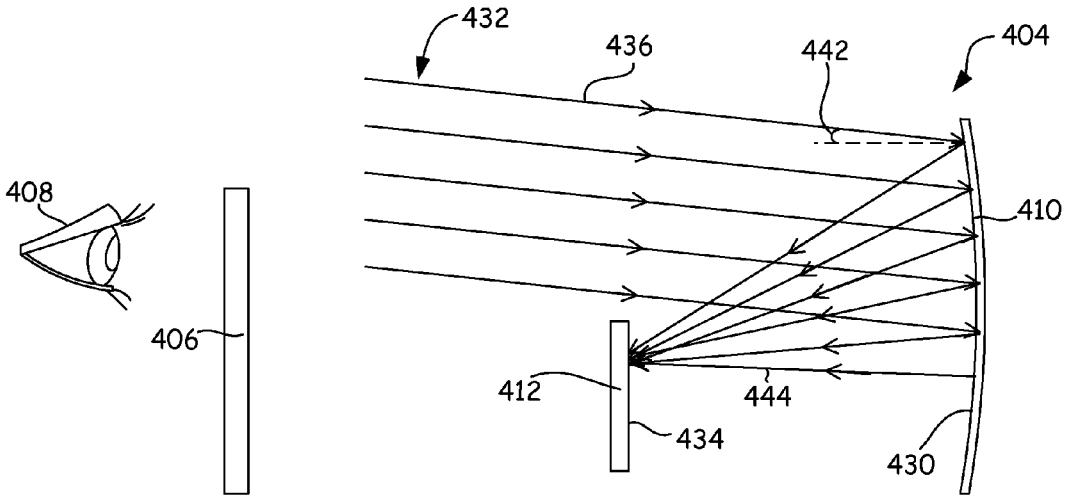
FIG. 5 illustrates a schematic diagram of a pixel in a first position under one embodiment.
Figure 6:
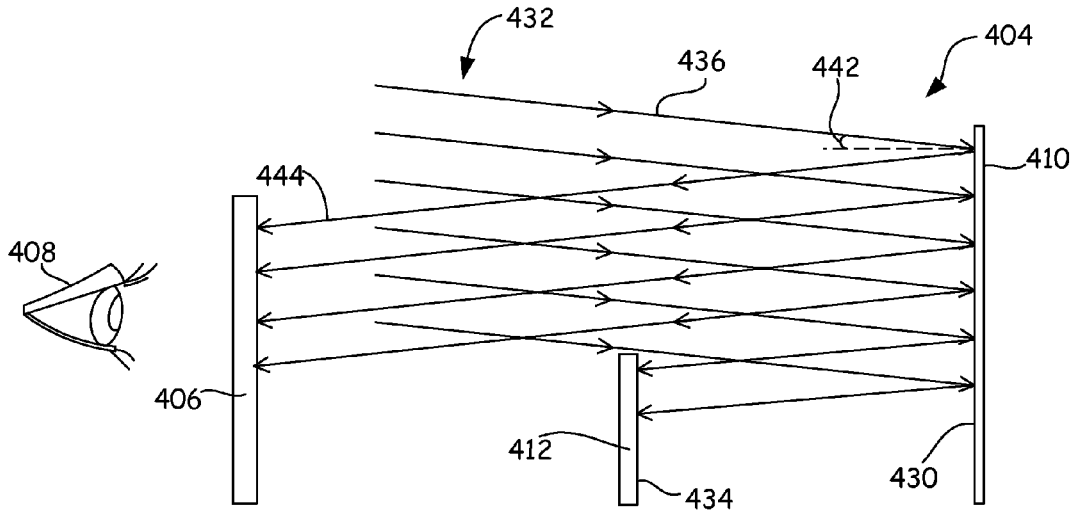
FIG. 6 illustrates a schematic diagram of the pixel of FIG. 5 in a second position under one embodiment.

FIGS. 5 and 6 illustrate schematic diagrams of a pixel 404 for use in modular display 100 of FIG. 1 or for use in monolithic display 200 of FIG. 2 under another embodiment. FIG. 5 illustrates a first position of pixel 404, while FIG. 6 illustrates a second position of pixel 404. Pixel 404 includes a primary element or mirror 410 and a secondary element 412. Primary element 410 and secondary element 412 can be any suitable shape, such as circular, rectangular or square. Primary element 410 is deformable between a first position as illustrated in FIG. 5 and a second position as illustrated in FIG. 6.

Primary element 410 includes a first surface 430 configured to reflect light received from a light source 432. In FIGS. 5 and 6, and in one embodiment, secondary element 412 includes a first surface 434 that is non-reflective or opaque. First surface 434 of secondary element 412 is spaced apart from and faces the first surface 430 of primary element 410. In one embodiment, primary element 410 comprises a metallic material, such as aluminum, that demonstrates desirable reflective, bending and conductive properties. However, it should be realized that primary element 410 can include non-metallic or dielectric materials that demonstrate reflective, bending and conductive properties. Such materials provide primary element 410 with reflective surfaces.

At least a portion of primary element 410 is deformed into the first position as illustrated in FIG. 5. A voltage is applied causing the shape of primary element 410 to deform from a planar shape to a parabolic shape. As illustrated in the first position of FIG. 5, light 436 from light source 432 is reflected from first surface 430 of the deformed primary element 410 at an angle of incidence 442. Light 444 is reflected from primary element 410 and is focused onto first surface 434 of secondary element 412. Since first surface 434 of secondary element 412 is non-reflective or opaque, secondary element 412 prevents light 444 from projecting onto screen 406. In the first position, pixel 404 appears dark to viewer 408.

As illustrated in the second position of FIG. 6, primary element 410 is deformed into the second position. In the second position, light 436 from light source 432 is reflected from first surface 430 of primary element 410 at an angle of incidence 442. Light 444 is reflected from primary element 410 and projected onto a screen 406 for viewing by a viewer 408. In the second position, pixel 404 appears bright to viewer 408.

Finding conditions at which primary element 310 (FIGS. 3 and 4) or 410 (FIGS. 5 and 6) deflect enough for efficient light focusing requires careful optimization of various parameters. The more primary element 310 or 410 deflects, the more light can be focused on secondary element 312 (FIGS. 3 and 4) or 412 (FIGS. 5 and 6). For example, the maximum deflection of an annular membrane, such as the annular membrane of primary element 310 having a fixed outer diameter 316 (FIGS. 3 and 4) is described by:

$$\delta_{\max} = \delta_{center} = \frac{3Pr^4(1-\nu^2)}{16Et^3} \tag{1}$$

where P is pressure, r is the radius of the reflecting surface of primary element 310, t is the thickness of primary element 310, v is Poisson ratio and E is Young's Modulus. In other words, 2r is the reflecting surface diameter of primary element 310. Pressure can be described by:

$$P = F_{ei}/A = \frac{\varepsilon\varepsilon_0 V^2}{2l^2} \tag{2}$$

where $F_{el}$ is electrostatic force between electrode 326 (FIGS. 3 and 4) and primary element 310, A is the area of electrode 326, $\epsilon_0$ is permittivity of free space, $\epsilon$ is relative permittivity of air, V is the applied voltage and l is the gap between electrode 326 and primary element 310. In Equation 2, it is assumed that the gap (l) is constant to make a first order approximation.

It should be realized that deflection can be increased by increasing the applied voltage V or radius r of primary element 310 and decreasing the thickness t of primary element 310 or distance l between electrode 326 and primary element 310. In general, applied voltage can be kept low in order to minimize power dissipation and simplify the device control. Making the radius r of primary element 310 larger also increases the pixel size. The minimum thickness t of primary element 310 is limited by the reflective properties of the material used for primary element 310. In an embodiment where aluminum is used, the smallest thickness can be approximately 100 nm. Such a size can be used to easily fabricate structure 320. The smallest gap l between electrode 326 and primary element 310 is limited by the fabrication procedure as well. In some cases, the gap l can be three times larger than the maximum deflection to avoid any shorting out of the pixel 304. Furthermore, desired optical properties of the system put additional constraints on the device parameters. The focusing quality depends on the minimum spot size and is calculated by:

$$\text{min spotsize} = 2.4\lambda f\# \tag{3}$$

where f is the focal length, f#=f/2r, and the focal length f of the parabolic shaped mirror or element corresponding to the shape of primary element 310 can be described by the following relation:

$$f = R/2 = \frac{r^2}{4\delta_{\max}} \tag{4}$$

where R is the geometric radius of the reflecting surface of primary element 310 when deformed.

After optimization utilizing the above equations, it is determined that, in one embodiment, but not by limitation, some device parameters can be: a primary element 310 radius r of 50 μm, a secondary element 312 radius of 25 μm, a radius of aperture 327 of 20μm, a gap l between primary element 310 and electrode 326 of 6 μm, a maximum deflection $\delta_{max}$ of primary element 310 of 1.8 μm, an applied voltage V of 32V, a focal length f of 350 μm, a distance between primary element 310 and secondary element 312 of 175 μm and a minimum spot size of 4.2 μm. Such parameters render a desirable optical quality.

Figure 7:
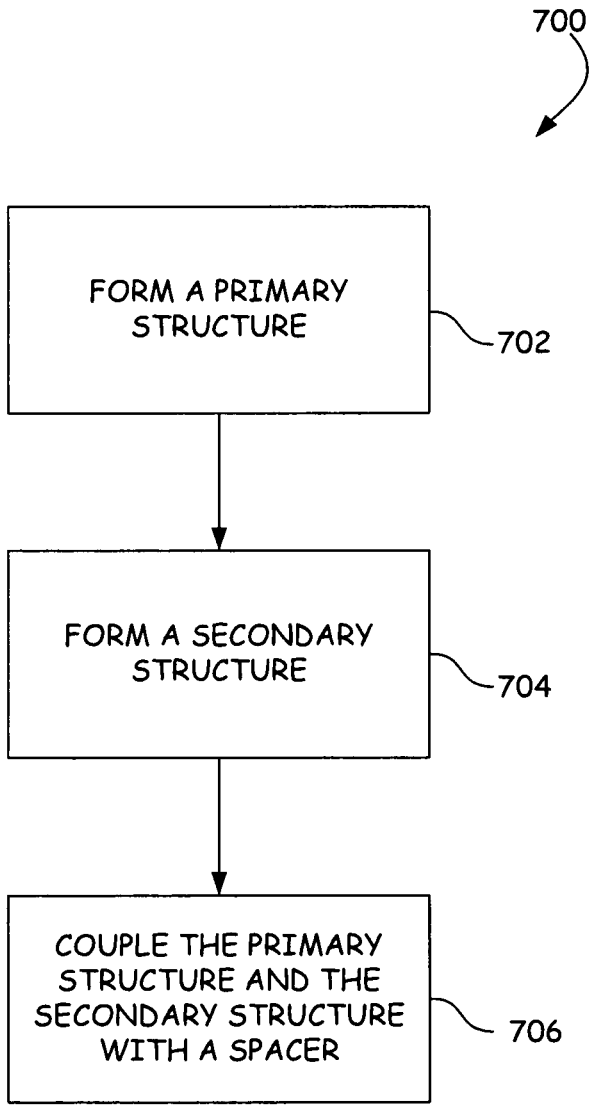
FIG. 7 illustrates a method of fabricating a pixel under one embodiment.
Figure 8A:
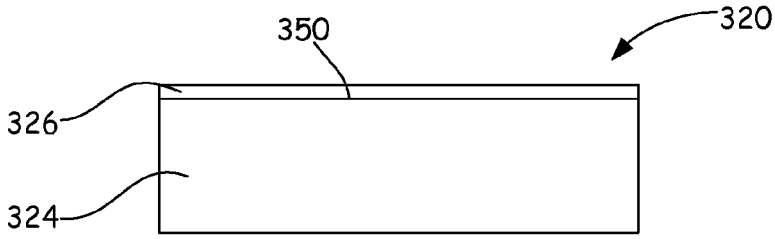
FIGS. 8A-8D illustrate steps in the process of forming a primary structure under one embodiment.
Figure 8B:
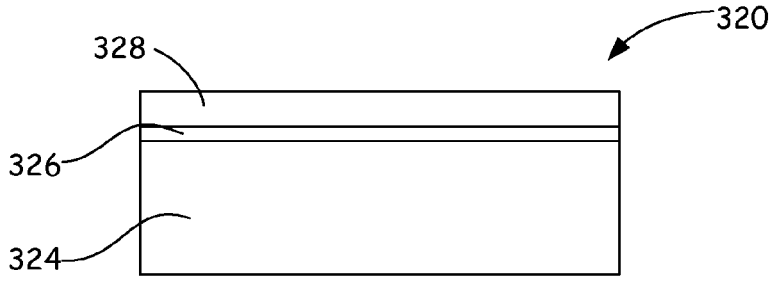
Figure 8C:
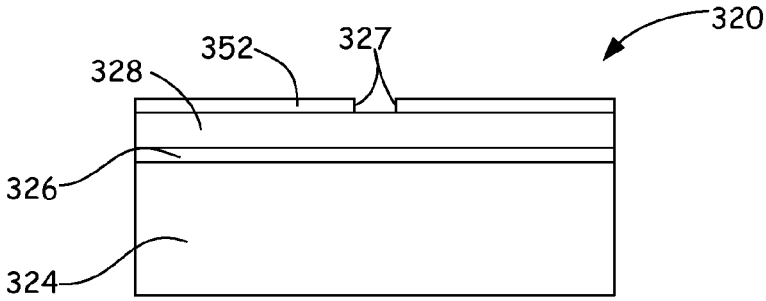
Figure 8D:
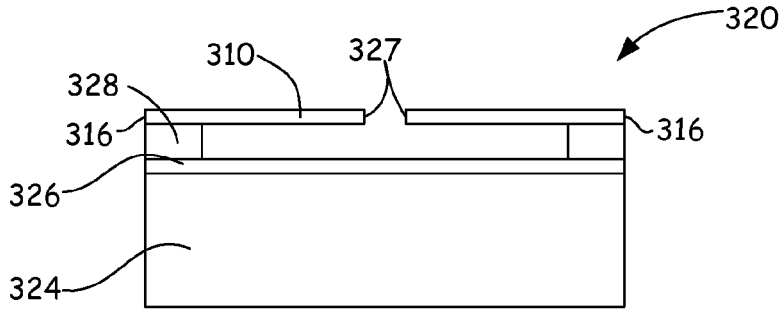

FIG. 7 illustrates a method 700 of fabricating pixel 304 under one embodiment. At block 702, primary structure 320 (FIG. 3) is formed. To form primary structure 320, a first conductive material or electrode 326 is coated on a first side 350 of first transparent substrate 324. Such a step is illustrated in FIG. 8A. As previously discussed, first transparent substrate 324 can include glass. However, other types of transparent substrates can be used. As also previously discussed, electrode 326 can be a conductive material, such as an ITO (indium tin oxide) or polymer that can demonstrate similar characteristics to that of ITO. Deposited on electrode 326 includes first spacer 328 as illustrated in FIG. 8B. For example, first spacer 328 can be a polyimide, such as HD4000, that is spin-coated on top of electrode 326. After the example polyimide is post-baked on a hot plate, a layer 352 demonstrating reflective properties is deposited on first spacer 328 to form primary element 310 as illustrated in FIG. 8C. For example and as previously discussed, layer 352 can be of aluminum that is sputtered onto first spacer 328. To form primary element 310 from layer 352, aperture 327 is formed in layer 352 (also illustrated in FIG. 8C). For example, positive photoresist, such as AZ1512, can be used for photolithography to form aperture 327 and then can be etched. Finally, first spacer 328 is partially release from layer 352 to form primary element 310 that is suspended as illustrated in FIG. 8D. For example, a gas can be used to eat first spacer 328 away from aperture 327 of primary element 310 towards an outer diameter 316 of primary element 310. Removal of first spacer 328 is stopped prior to reaching outer diameter 316 of primary element 310 such that at least a portion of primary element is fixed to structure 320.

Figure 9A:
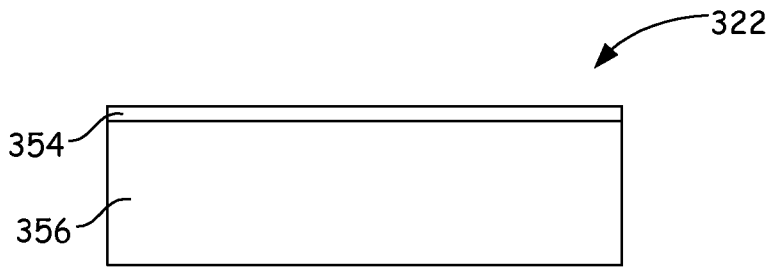
FIGS. 9A-9B illustrate steps in the process of forming a secondary structure under one embodiment.
Figure 9B:
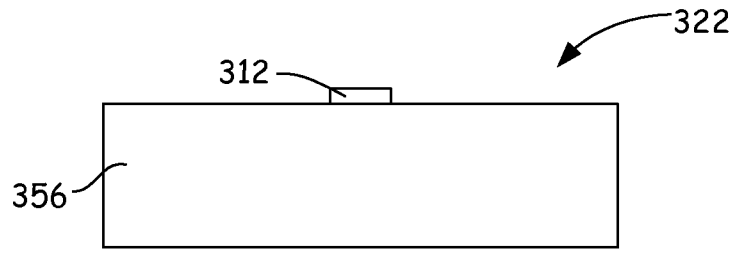
Figure 10:
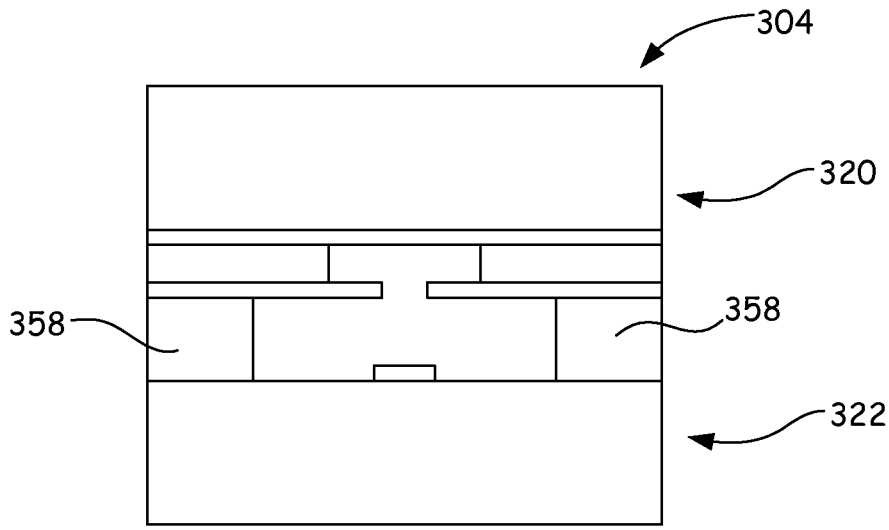
FIG. 10 illustrates a fabricated pixel as discussed in FIGS. 7, 8A-8D and 9A-9B.

At block 704 of the method 700 illustrated in FIG. 7, secondary structure 322 is formed. To form secondary structure 322, a layer 354 is deposited on a substrate 356, such as glass, to form secondary element 312 as illustrated in FIG. 9A. As previously discussed layer 354 has reflective properties and can be a metallic material, such as aluminum. For example, aluminum can be sputtered onto substrate 356. To form secondary element 312, a portion of layer 354 is removed as illustrated in FIG. 9B. For example, layer 354 can be patterned using photolithography. At block 706 of the method 700 illustrated in FIG. 7, primary structure 320 and secondary structure 322 are coupled together with a second spacer 358 and aligned to form pixel 304 as illustrated in FIG. 10.

Figure 11:
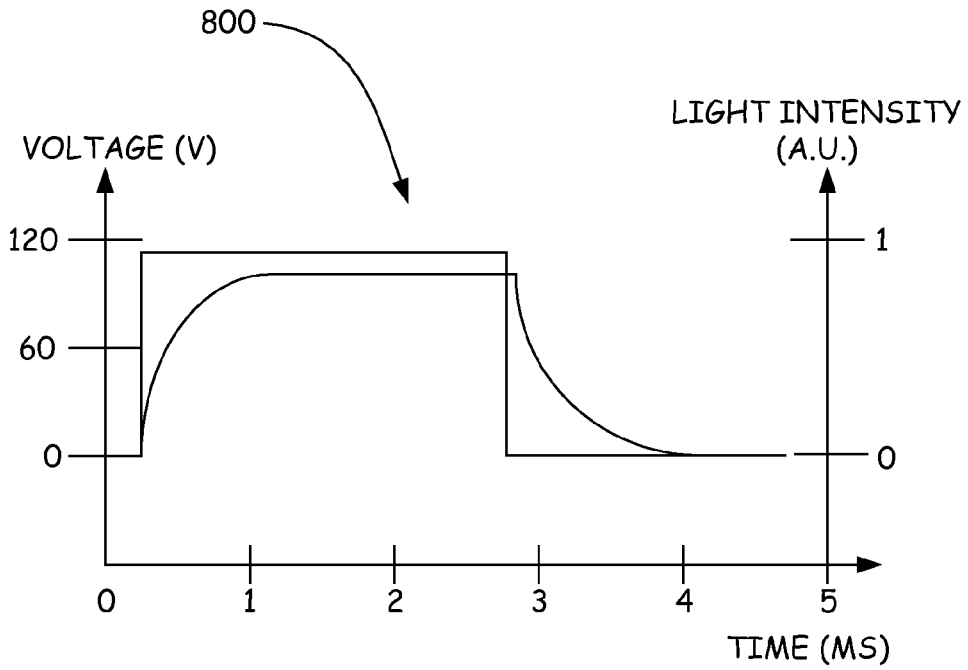
FIG. 11 illustrates a graphical representation of response of an array of pixels to the modulation signal in the form of a square wave.
Figure 12:
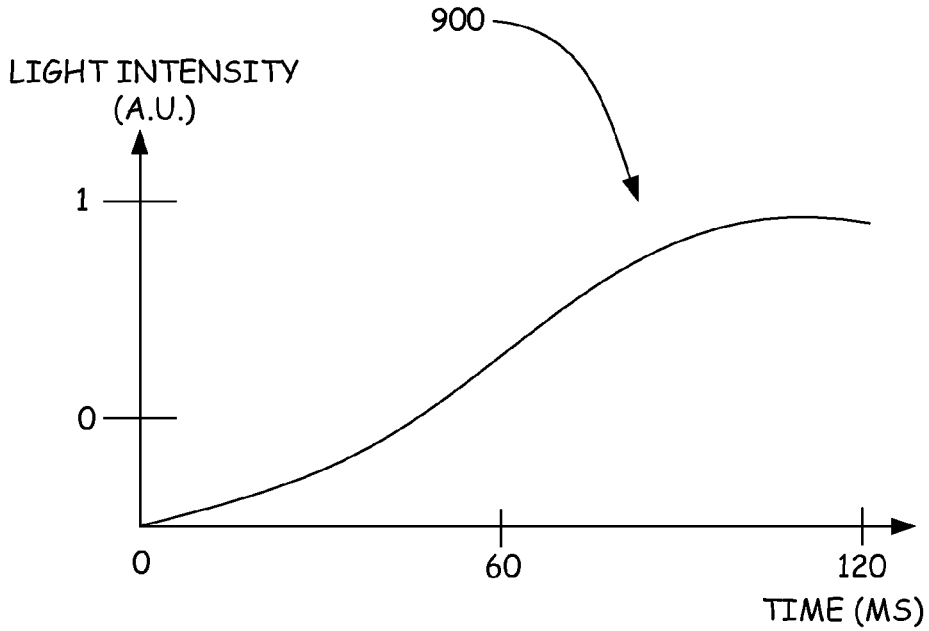
FIG. 12 illustrates a graphical representation of response of an array of pixels in the form of a transfer function.

FIG. 11 illustrates the response of an array of pixels 304 or 404 in the form of a square wave 800. FIG. 12 illustrates the response of an array of pixels 304 or 404 in the form of a transfer function 900. As illustrated in FIG. 11, the rise time is 0.625 ms and the fall time is 0.61 ms, which gives response times that are less than 2 ms. This means that pixel 304 or 404 is fast enough to display colors using sequential RGB as previously discussed. Moreover, the pixel transfer function illustrated in FIG. 12 shows that light intensity can smoothly and monotonically change from 0 to 1. Therefore, color shades can be realized by varying color intensity in a single cycle between a first position (FIGS. 3A and 5) and a second position (FIGS. 4A and 6) in contrast with binary pixels, which use several cycles for every color shadow. In particular, pixel 304 and 404 can experience different light intensities between the first position and the second position by applying different amounts of voltage over the cycle.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A pixel comprising:

a primary element including a first, reflective surface configured to reflect light received from a light source;

a secondary element having a first surface that is spaced apart from and facing the first, reflective surface of the primary element; and wherein the first, reflective surface of the primary element is deformable to focus reflected light onto the first surface of the secondary element, the first, reflective surface being deformable from a first position to a second position in which the first, reflective surface has a substantially parabolic shape by adjusting a radius of curvature of the first, reflective surface of the primary element to change a focal length of the first, reflective surface, wherein the pixel appears dark when the first, reflective surface of the primary element is in one of the first position and the second position and the pixel appears bright when the first, reflective surface of the primary element is in the other one of the first position and the second position.

2. The pixel of claim 1, wherein the first surface of the secondary element comprises a reflective surface.

3. The pixel of claim 2, wherein when the first surface of the primary element is in the first position, light emitted from the light source toward the first surface of the primary element is reflected back towards the light source causing the pixel to appear dark to a viewer.

4. The pixel of claim 2, wherein when the first surface of the primary element is deformed into the second position, at least a portion of the light from the light source is reflected from the secondary element towards a viewer causing the pixel to appear bright to the viewer.

5. The pixel of claim 2, wherein the secondary element is positioned between the primary element and the light source.

6. The pixel of claim 1, wherein the first surface of the secondary element comprises a non-reflective surface.

7. The pixel of claim 6, wherein when the first surface of the primary element is in the first position, light from the light source reflects on the first surface of the primary element at an angle of incidence and is projected onto a screen for viewing by a viewer.

8. The pixel of claim 6, wherein when the first surface of the primary element is deformed into the second position, light from the light source reflects on the first surface of the primary element at an angle of incidence and is focused on the secondary element, wherein the second position of the first surface of the primary element prevents light from projecting onto a screen for viewing by a viewer.

9. The pixel of claim 1, further comprising a spacer coupled to a first portion of the primary element and an electrode.

10. The pixel of claim 9, wherein a second, remaining portion of the primary element is configured to deform when a differential voltage is simultaneously applied to the primary element and to the electrode.

11. The pixel of claim 9, wherein the primary element includes an aperture that extends between the first surface and an opposing second surface, and when the first, reflective surface of the primary element is deformed into the second position, light is allowed to pass through the aperture for viewing by a viewer.

12. The pixel of claim 11, wherein an intensity of the light that is allowed to pass through the aperture for viewing by a viewer varies in intensity when varying amounts of differential voltage are applied.

13. The pixel of claim 1, wherein the first, reflective surface is substantially concave in the second position.

14. A display device comprising:

a screen; and at least one module having an array of pixels, each pixel including:

a deformable primary mirror having a reflective first surface, an opposing second surface, and an aperture that extends between the first and second surfaces, wherein the reflective first surface faces a direction away from the screen and is at least partially deformable between a first position and a second position; and a secondary mirror having a reflective surface that faces the screen and the aperture of the primary mirror, the reflective surface of the secondary mirror being configured to reflect light, received from the primary mirror, through the aperture of the primary mirror and towards the screen, the screen being configured to receive light emitted through the aperture of each pixel to form a viewable image;

wherein, when the reflective first surface of the primary mirror is in the second position, the reflective first surface of the primary mirror reflects light from a light source toward the secondary mirror and the secondary mirror reflects the light through the aperture and into the screen such that the pixel appears bright; and wherein, when the reflective first surface of the primary mirror is in the first position, the reflective first surface of the primary mirror reflects light from the light source such that the pixel appears dark.

15. The pixel of claim 14, wherein, when the reflective first surface of the primary mirror is in the first position, light emitted from the light source toward the reflective first surface of the primary mirror is reflected away from the secondary mirror and back towards the light source, causing the pixel to appear dark to a viewer.

16. The pixel of claim 14, wherein, when the reflective first surface of the primary mirror is deformed into the second position, at least a portion of the light emitted from the light source toward the reflective surface of the primary mirror is reflected from the first surface of the secondary mirror towards a viewer causing the pixel to appear bright to the viewer.

17. The display device of claim 14, wherein each pixel comprises the secondary mirror positioned between the primary mirror and the light source.

18. The display device of claim 17, wherein the secondary mirror of each pixel is aligned with the aperture formed in the primary mirror of the pixel.

19. A method of fabricating a pixel, the method comprising:

forming a primary structure comprising:

a first conductive material deposited on a first substrate;

a first spacer comprising a material deposited on the first conductive material;

a second conductive material deposited on the first spacer and forming an aperture, the second conductive material having a reflective surface that is deformable between a first and a second position in response to a voltage applied to the second conductive material, wherein the reflective surface has a substantially parabolic shape by adjusting a radius of curvature of the reflective surface of the second conductive material to change a focal length of the reflective surface, the spacer being at least partially disposed between the first and second conductive materials; and removing a portion of the first spacer coupled to the second conductive material through the aperture; forming a secondary structure comprising an opaque material deposited on a second substrate; and coupling the primary structure and the secondary structure together with a second spacer.

* * * * *